United States Patent [19]

Culley et al.

[11] Patent Number: 4,594,501

[45] Date of Patent: Jun. 10, 1986

[54] PULSE WIDTH MODULATION OF PRINTHEAD VOLTAGE

[75] Inventors: Paul R. Culley; Steven J. Wallace, both of Houston, Tex.

[73] Assignee: Texas Instruments Incorporated, Dallas, Tex.

[21] Appl. No.: 195,557

[22] Filed: Oct. 9, 1980

[51] Int. Cl.[4] ..... H05B 1/02

[52] U.S. Cl. ..... 219/492; 219/497; 219/209; 219/216; 219/501; 323/288; 323/285; 323/283; 323/351; 307/265

[58] Field of Search ..... 219/492, 494, 497, 499, 219/501, 209, 210, 216, 543; 323/282, 288, 285, 283, 351; 307/265, 240; 318/341, 599; 346/140 R, 76 PH

[56] References Cited

U.S. PATENT DOCUMENTS

| | | | |
|---|---|---|---|
| 3,308,271 | 3/1967 | Hilbiber | 219/210 |
| 3,881,085 | 4/1975 | Traister | 219/501 |
| 3,988,569 | 10/1976 | Henrion | 219/543 |
| 3,999,190 | 12/1976 | Brown et al. | 219/501 |
| 4,030,015 | 6/1977 | Herko et al. | 323/288 |
| 4,113,391 | 9/1978 | Minowa | 219/216 |
| 4,130,853 | 12/1978 | Baker | 219/492 |
| 4,135,122 | 1/1979 | Holmquist et al. | 219/492 |
| 4,156,166 | 5/1979 | Shapiro et al. | 323/288 |
| 4,168,421 | 9/1979 | Ito | 219/216 |
| 4,188,528 | 2/1980 | Wierzchowski et al. | 219/492 |

*Primary Examiner*—M. H. Paschall

*Attorney, Agent, or Firm*—Thomas G. Devine; Leo N. Heiting; Melvin Sharp

[57] ABSTRACT

An electronic thermal printer has a thermal printhead to which is applied a train of pulses which is pulse width modulated. A power switch connects and disconnects the printhead from a DC power source. The pulse train is integrated, scaled and applied as an input to a comparator circuit. The thermal printhead has a temperature sensing diode whose output is applied, as a reference voltage, to the other input of the comparator. During a print cycle, the output of the temperature sensing diode is cut off and the reference voltage is capacitively stored and held as the reference voltage. The output of the comparator circuit clears a latch circuit whose input is provided by a system clock and whose output is connected to control the power switch. The comparator provides an output when the integrated voltage reaches the reference voltage, clearing the latch. Since the latch is supplied with signals from the system clock, a constant frequency is maintained. However, the varying output from the comparator clearing the latch provides varying pulse widths. In this manner, pulse width modulation of the voltage input pulses to the thermal printhead is achieved.

11 Claims, 4 Drawing Figures

PULSE WIDTH MODULATION OF PRINTHEAD VOLTAGE

BACKGROUND OF THE INVENTION

1. Field of the Invention

This invention relates to control of voltage supplied to thermal printheads and in particular to pulse width modulation of such voltage.

1. Description of the Prior Art

Driving a thermal printhead requires maintenance of an adjustable temperature while printing, despite variations in character density and ambient temperature.

In the prior art, it is common to use a linear regulation scheme for providing the power to the printhead, and a feedback and comparison loop to adjust the temperature. A series pass transistor is employed to apply power to the thermal printhead. However, the use of such a transistor necessarily wastes approximately one half of the supplied power.

To overcome this problem, a switching regulator power supply has been employed to provide a controlled voltage to the thermal printhead. Such a switching regulator for a thermal printhead is described and claimed in copending U.S. patent application Ser. No. 146,992 filed May 5, 1980 and assigned to the assignee of this invention. This use of a switching regulator to supply voltage to a thermal printhead results in a significantly more efficient means of supplying power.

In the present invention, instead of supplying a regulated voltage to the thermal printhead, a pulse train is applied and such pulse train is effectively regulated. The result is an efficient, low cost regulation circuit.

BRIEF SUMMARY OF THE INVENTION

A pulse width modulator circuit regulates the maximum voltage and minimum voltage times of a pulse train applied to a thermal printhead during a ten millisecond print cycle as used in this preferred embodiment. The thermal printhead incorporated in this preferred embodiment is described in U.S. Pat. No. 3,988,569—"Thermal Printhead With Memory", issued on Oct. 26, 1976. This particular printhead, once energized, remains energized until the power applied drops below a critical value. The thermal printhead has a temperature sensing diode whose junction resistance changes with temperature, thus providing a signal indicative of the printhead temperature. This signal, combined with a signal contrast adjust circuit, is applied, through a transmission gate, to a store and hold capacitor and to a comparator. The transmission gate shuts off the output from the sense diode and the contrast circuit when the print cycle is active. The store and hold capacitor provides the reference voltage necessary for a comparison with the integrated and scaled voltage representing the pulse train applied to the thermal printhead.

A latch circuit has, as its input, squarewave pulses from a system clock. It has a clear input from the output of the comparator circuit so that when the integrated and scaled pulse train reaches the reference voltage, which has been provided by the output of the sense diode and contrast circuit, the latch circuit is cleared. The output of the latch circut ultimately controls a power switch circuit which applies a DC power source to the thermal printhead. In this preferred embodiment, a second power switch is employed to maintain a minimum voltage of six volts so that the thermal printhead remains active during the print cycle. That is, the DC power supplied is at +30 volts going to a minimum of +6 volts during the print cycle. When the print cycle ends, both power transistors are shut off. A combination of the comparator and the latch circuit provides a pulse width modulator for maintaining the system clock frequency at a constant rate, but varying the on and off time of the power switch to provide varying pulse widths, dependent upon the requirement.

The principle object of this invention is to provide a reliable and simple circuit for applying voltage to a thermal printhead.

Another object of this invention is to provide a circuit for pulse modulated regulation of voltage applied to a thermal printhead.

These and other objects will be made evident in the detailed description that follows.

DETAILED DESCRIPTION OF THE INVENTION

Figure 1A:
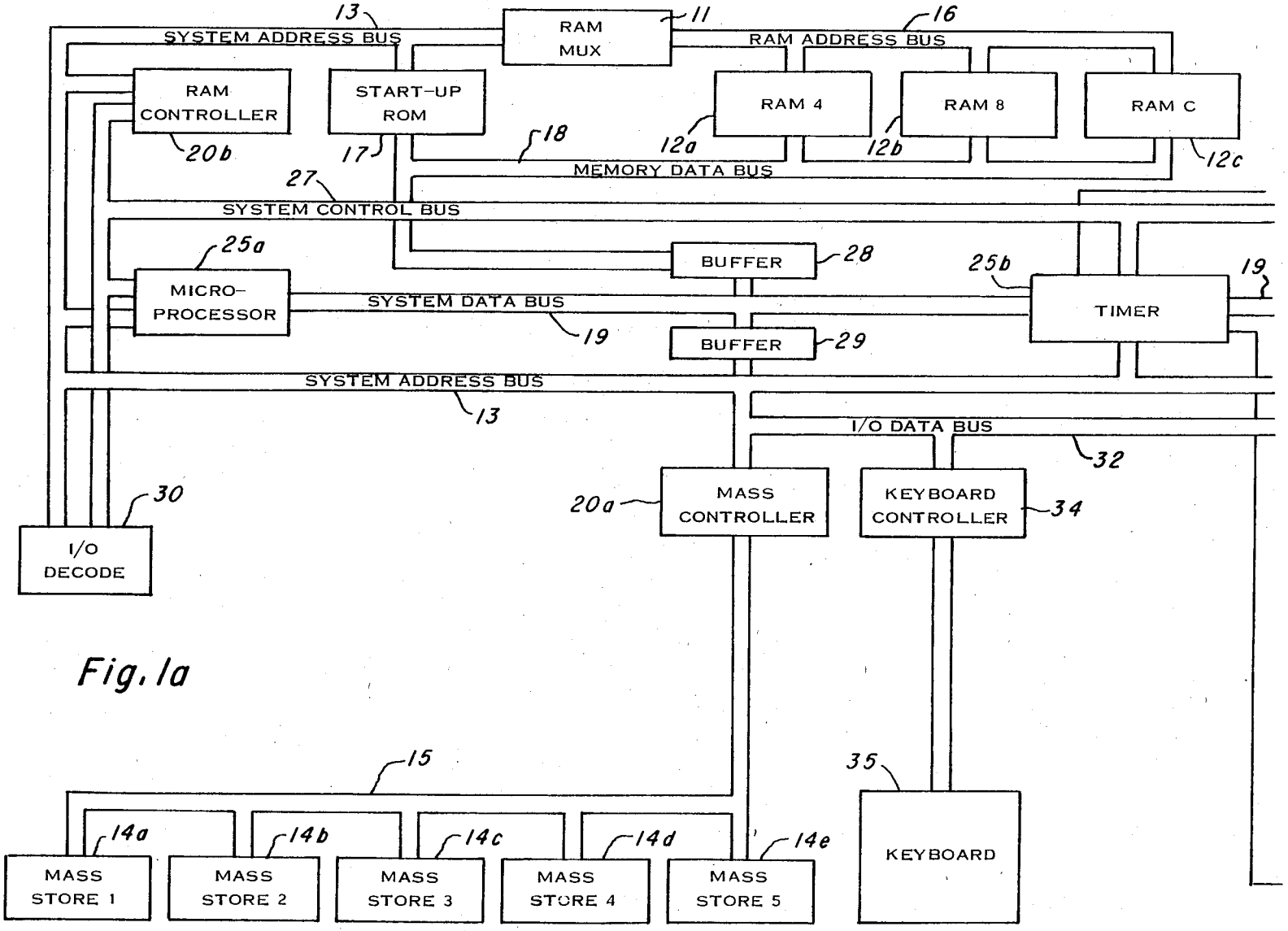
FIGS 1A and 1B show block diagrams of an electronic printing terminal employing the circuit for pulse modulated regulation of voltage for a thermal printhead of this invention.
Figure 1B:
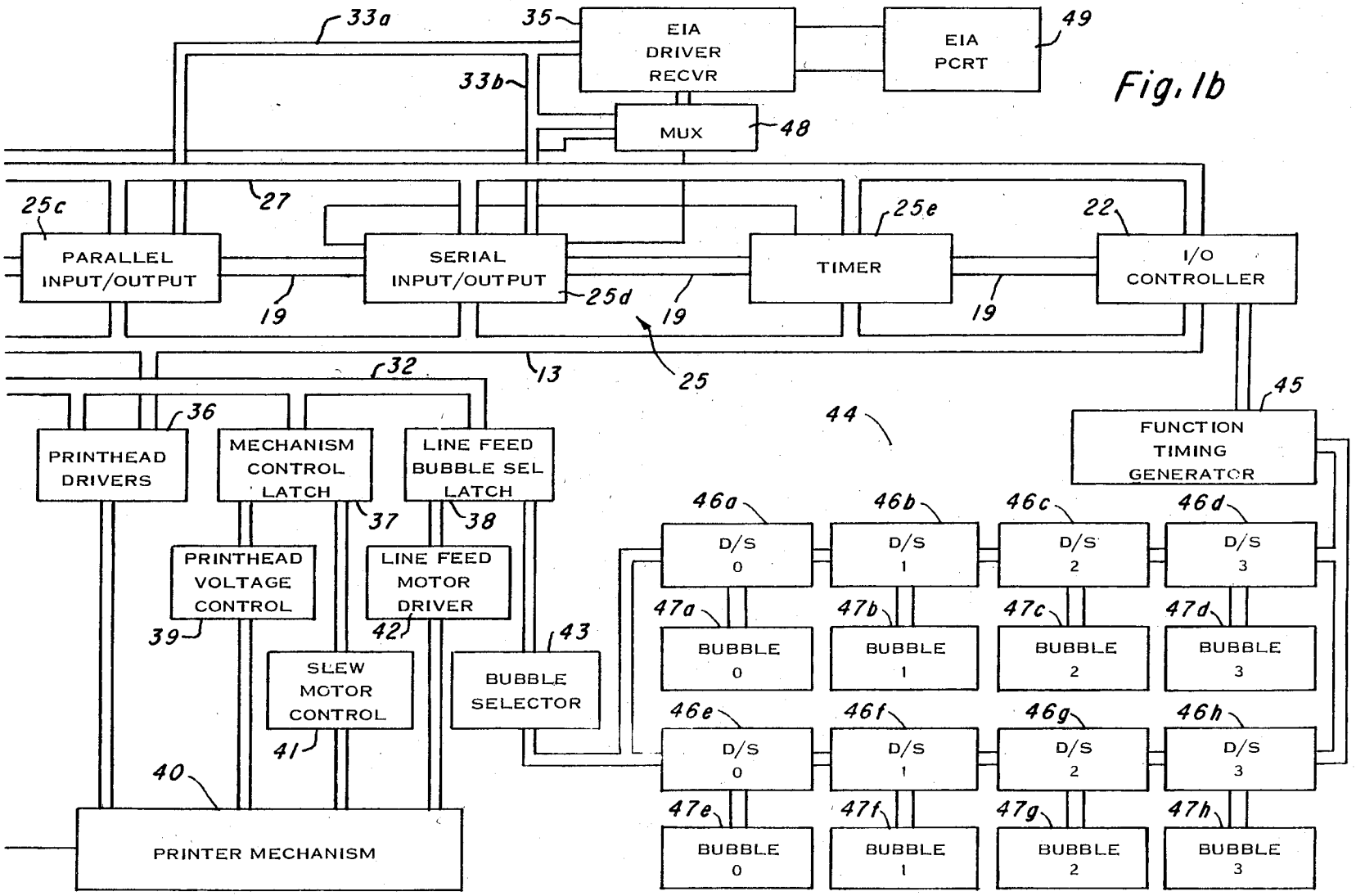

Turning first to FIG. 1, the printing terminal employing the regulator of this invention is illustrated in block form. Microprocessor 25*a*, timer 25*b*, parallel input/output unit 25*c*, serial input/output unit 25*d* and timer 25*e* form the total microprocessor of this invention. The particular microprocessor selected for implementing this invention is the Zilog Company Z80A made up of components 25*a* through 25*e*, all described in "Zilog Microcomputer Components Data Book" dated Feb. 1980. System control bus 27 extends from microprocessor 25*a* to timer 25*b*, to timer 25*e* and to I/O controller 22. System address bus 13 extends from microprocessor 25*a* to timer 25*b*, to parallel input/output unit 25*c*, to serial input/output unit 25*d*, to timer 25*e* and to I/O controller 22. I/O controller 22 is Texas Instruments Incorporated type TMS5502 and is used for communication with function timing generator 45 for use with bubble memory 44. Bubble memory 44 is comprised of units 47*a*–47*h* controlled by drive sense modules 46*a*–46*h*. The bubble memory is peripheral to this invention and need not be described in detail here.

The system data bus 19 from microprocessor 25*a* is serially connected to microprocessor units 25*b*–25*e*, terminating in I/O controller 22. Buffers 28 and 29 are connected to system data bus 19. Buffer 28 interconnects memory data bus 18 with system data bus 9. Buffer 29 interconnects I/O data bus 32 with system data bus 9. I/O data bus 32 is connected to keyboard controller 34, printhead drivers 36, mechanism control latch 37 and line feed bubble select latch 38. Latch 38 has an output connected to the input of bubble selector 43 which in turn is connected to the bubble memory 44. An output from latch 38 provides an input to line feed motor driver 42 which is part of a printer having an output to the printer mechanism 40. Printhead drivers 36 also are connected to printer mechanism 40. Latch 37 has one output connected to printhead voltage control 39 which in turn has an output connected to the printer mechanism 40. Latch 37 also has an output to slew motor control 41 whose output is connected to the printer mechanism 40. Printhead voltage control 39 is described in detail in FIG. 2. Slew motor control 41 is fully described in copending U.S. patent application Ser. No. 193,988, filed Oct. 6, 1980, entitled "Use of Motor Winding as Integrator to Generate Sawtooth for Switch Mode Current Regulator", and assigned to the assignee of this invention, now U.S. Pat. No. 4,323,886.

Keyboard controller 34 is connected to keyboard 35. The keyboard 35 and keyboard controller 34 are well known and need not be described in detail.

I/O decode 30 is made up of a programmable logic array and a decoder. The combination of these two components provides output signals in response to command and address input signals from microprocessor 25*a*.

EIA port 49 is connected to EIA driver-receiver 35 which in turn is connected through bus 33*a* to parallel input/output unit 25*c* and through bus 33*b* to serial input/output unit 25*d*. A baud rate source multiplexer 48 is connected to unit 35 and also to unit 25*d* to provide synchronization. The EIA port 49 and associated hardware described complies with a standard for communication, is old in the art and need not be described in detail here.

Mass controller 20*a* is connected to buffer 29 through I/O data bus 32. Mass store 1 through mass store 5 (14*a*–14*e*) form the read-only mass memory 14 and are connected by bus 15 to mass controller 20*a*.

RAM controller 20*b* is connected to I/O decode 30 and microprocessor 25 by way of system control bus 27. RAM controller 20*b* is also connected by way of the system address bus 13 to microprocessor 25*a* and I/O decode 30. Start-up ROM 17 is connected to memory data bus 18 and to system address bus 13. Its permanently stored instructions form a boot strap program to enable the microprocessor 25*a* to utilize preliminary instructions.

RAM multiplexer 11 receives its inputs from system address bus 13 and addresses RAM 12 which is connected by RAM address bus 16 to RAM mux 11. Memory data bus 18 is connected to RAM 12 as well.

RAM 12, start-up ROM 17, controllers 20*a* and 20*b*, and read-only mass memory 14, together with I/O decode 30 and microprocessor 25, and associated buses and buffers enable a virtual memory technique which is fully described in copending U.S. patent application Ser. No. 191,892 filed Sept. 29, 1980entitled "Virtual Memory Microcomputer Architecture", and assigned to the assignee of this invention.

Figure 2:
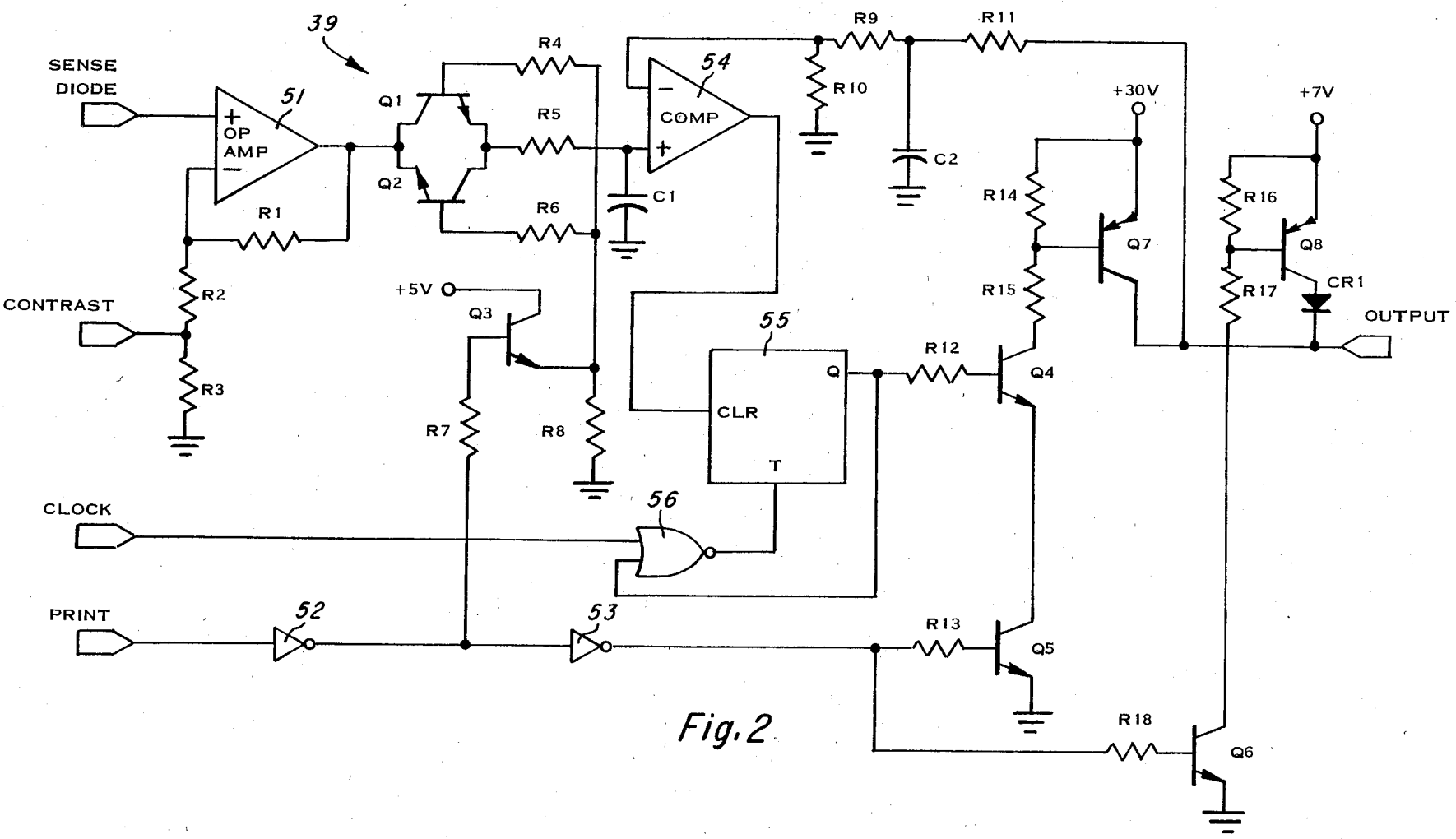
FIG. 2 is a schematic diagram of the circuit for pulse modulated regulation.

Printhead voltage control circuit 39 is illustrated in FIG. 2. Non-inverting operational amplifier 51 has one input from a temperature sense diode (not shown) which is part of the thermal head assembly used in this preferred embodiment. The other input to operational amplifier 51 is provided by a manually adjustable contrast control, a signal from which is applied to a terminal connected between resistors R2 and R3, with resistor R3 being grounded and resistor R2 being connected to the other input of operational amplifier 51. The output of operational amplifier 51 has a feedback resistor R1 also connected to its other input. The output of operational amplifier 51 also is connected to a transmission gate which is comprised of transistors Q1, Q2 and Q3. The output of operational amplifier 51 is connected to the collector of transistor Q1 and to the emitter of transistor Q2. The emitter of transistor Q1 is connected to the collector of transistor Q2. The base of transistor Q1 is connected, through resistor R4, to the emitter of control transistor Q3. In like manner, the base of transistor Q2 is connected through resistor R6 to the emitter of control transistor Q3. The emitter of control transistor Q3 is connected, through resistor R8, to ground. The collector of transistor Q3 is connected to +5 volts and its base is connected, through resistor R7 to the output of inverter 52.

A print signal, from microprocessor 25, is applied to the print terminal and inverted through inverter 52 which has output inverted again, through inverter 53. The output of inverter 53 is applied, through resistors R13 and R18, to the bases of transistors Q5 and Q6 respectively.

The output of the transmission gate is at the junction of the emitter of transistor Q1 and the collector of transistor Q2 which, through resistor R5, is applied to store and hold capacitor C1 and to one terminal of comparator 54. The other plate of capacitor C1 is connected to ground. Comparator 54 comprises, in integrated form, a Texas Instruments type LN339 comparator. The output of comparator 54 is connected to the clear input of toggle flip flop 55.

A system clock (not shown) provides a 20 KHz square wave pulse train to one input of NOR gate 56 whose other input is provided from the Q output of toggle flip flop 55. The output of NOR gate 56 provides the input to flip flop 55. NOR gate 56 permits the setting of flip flop 55 only when the clock and the Q output of flip flop 55 are both low.

The Q output of flip flop 55 is connected, through resistor R12, to the base of transistor Q4 whose emitter is connected to the collector of transistor Q5. The emitter of transistor Q5 is connected to ground. The collector of transistor Q4 is connected, through resistor R15, to the base of power transistor Q7 whose emitter is connected to +30 volts and through resistor R14 to the base of transistor Q7. The collector of transistor Q7 is connected to the output terminal for providing a train of voltage pulses to the thermal printhead (not shown). The emitter of transistor Q6 is grounded and its collector is connected, through resistor R17, to the base of power transistor Q8 whose emitter is connected to +7 volts and, through resistor R16, to its base. The collector of transistor Q8 is connected to the anode of diode CR1 whose cathode is connected to the output terminal. It can be seen that when a signal is applied to the print terminal, transistor Q6 is turned on, turning on transistor Q8 which then provides an approximate six volts at the output terminal.

The output terminal is connected, through resistor R11, to one terminal of capacitor C2 whose other terminal is grounded. Capacitor C2 and resistor R11 provide an RC circuit for integrating the output pulses. The output is also connected, through resistor R11, to a divider network made of resistors R9 and R10 with resistor R9 being in series with resistor R11 and resistor R10 in series with resistor R9. The other side of resistor R10 is grounded. The values of resistors R9 and R10 are selected so that at the junction of these two resistors a ten to one reduction in amplitude is obtained and is applied as the other input to comparator 54. When the voltage at the junction of resistors R9 and R10 reaches the reference voltage at the other terminal of comparator 54, supplied by the temperature sense diode voltage and the contrast voltage, comparator 54 is activated.

MODE OF OPERATION

Figure 3:
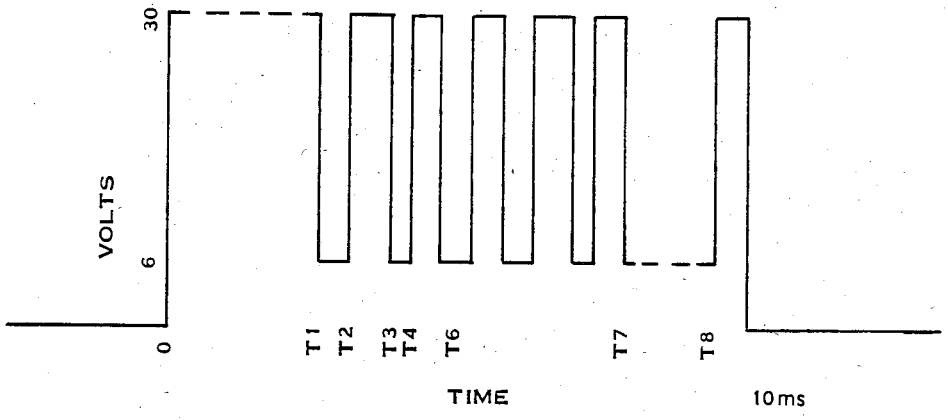
FIG. 3 illustrates, in idealized form, a pulse modulated train of voltage pulses applied to the thermal printhead.

The microprocessor 25 of FIG. 1 provides a print command and, in this preferred embodiment, a ten millisecond print cycle is initiated. The print signal is impressed on the print terminal of FIG. 2, inverted through inverter 52 and again through inverter 53 to turn on transistors Q5 and Q6. Assume that the contrast control has been set from previous use to some value acceptable to the operator. This contrast input is applied to the contrast terminal and serves as one input to the operational amplifier 51 whose other input comes from the temperature sense diode. Assuming that the temperature has been low, then the voltage impressed on the sense diode input is relatively high. This voltage is transmitted through the transmission gate formed of transistors Q1 and Q2 to charge hold and store capacitor C1 and to provide an input to the positive terminal of comparator 54. When the print cycle occurs, transistor Q3 is shut off thereby shutting off transistors Q1 and Q2. The system clock applies square wave pulses at a 20 KHz rate to NOR gate 56. With flip flop 55 cleared, the Q output is low, and when combined with a low clock input, sets flip flop 55. With flip flop 55 set, the Q output is high and further clock pulses are blocked from the input of flip flop 55. With the Q output high, transistor Q4 conducts, causing power transistor Q7 to conduct. This places 30 volts on the thermal printhead as indicated in FIG. 3. The voltage on the printhead is fed back and integrated by RC circuit R11 and C2, and scaled through resistors R9 and R10, being applied in scaled form to comparator 54.

Referring to FIG. 3, at time T0 of a ten millisecond print cycle, the voltage rises to 30 volts and then, at some time T1, depending upon the temperature sensed by the sense diode and stored in capacitor C1 as a reference voltage, the scaled and integrated voltage reaches the reference voltage and activates comparator 54. Comparator 54 then causes flip flop 55 to clear, shutting off transistor Q4 and power transistor Q7 causing the voltage to decline as shown at time T1 in FIG. 3. However, transistor Q6 was turned on by the print cycle and it causes power transistor Q8 to turn on. Transistor Q8 is connected to +7 volts and by the drop through the transistor Q8 and diode CR1, a six volt minimum is provided. The six volt minimum voltage is necessary, in this preferred embodiment, because of the particular printhead selected for use in the controlled printer. That is, if the voltage is dropped to ground, for example, the printhead would no longer be selected. Of course, if a different printhead had been used in this invention, the six volt minimum voltage would not be required.

The integrated voltage drops until comparator 54 is deactivated. At that time, the flip flop 55 is again set in the same manner as indicated earlier, causing power transistor Q7 to conduct, again placing 30 volts, as indicated at time T2 in FIG. 3, on the termal printhead.

At time T3, the integrated voltage again rises to the value of the reference voltage and again transistor Q7 is turned off in the same manner as described earlier. At time T4 the power transistor Q7 is again turned on. Notice that FIG. 3 illustrates a longer time interval between times T2 and T3 than between T3 and T4. However, the time interval between T2 and T4 equals that between T4 and T6, illustrating that the frequency of the cycle remains constant yet the pulse width is changed. FIG. 3 therefore illustrates in idealized form, a pulse width modulation of the voltage applied to the thermal printhead. The dashed line between times T7 and T8 in FIG. 3 is to indicate that a number of pulses follow until the final pulse at time T8 which ends at zero volts indicating the end of the print cycle. The 20 KHz system clock, with a ten millisecond print cycle, provides for a total of two hundred modulation cycles, decreased by the time required to initially cause comparator 54 to operate.

The operation continues as indicated above whenever a print cycle is initiated by the microprocessor 25.

It is obvious to one of ordinary skill in the art to substitute components for a particular application, to change values of components and to alter the circuitry for the particular situation, all without departing from the scope of the invention as set out in the appended claims.

What is claimed is:

1. An electronic thermal printing terminal having a system clock, an available DC power source, and a thermal printhead selectively activated during the print cycle, the printhead including a temperature sense diode, comprising:

(a) power transistor switching means connected to the DC power source and to the thermal printhead;

(b) control timing means comprising a latch circuit having an output electrically connected to the control electrode of the power transistor switching means, an input connected to receive signals from the system clock, and a reset input for clearing the latch circuit, for permitting the power transistor switching means to close and open, thereby respectively connecting and disconnecting the thermal printhead from the DC power source;

(c) duty cycle varying means having an output connected to the reset input for activating the control timing means to vary the time of the power transistor switching means to be opened and closed within a fixed cycle time, and connected to receive the output of the temperature sense diode as a reference voltage; and (d) pulse integrating means connected to be printhead for providing a voltage indicative of power applied to the printhead, and connected to the duty cycle varying means to activate the duty cycle varying means when the indicative voltage reaches the reference voltage, and to deactivate the duty cycle varying means when the indicative voltage drops below the reference voltage.

2. The terminal of claim 1 wherein the latch means comprises a flip flop and a logic gate, the output of the flip flop providing one input to the logic gate and the system clock providing the other input to the logic gate, arranged so that once set, the flip flop cannot change state until cleared by the reset input.

3. The terminal of claim 1 wherein the duty cycle varying means comprises a comparator means having one input electrically connected to the reference voltage and another input connected to the pulse integrating means to cause the latch circuit to clear when the amplitude of the indicative voltage reaches the reference voltage amplitude.

4. The terminal of claim 1 wherein the pulse integrating means comprises a resistor-capacitor circuit.

5. The terminal of claim 3 wherein the pulse integrating means comprises a resistor-capacitor circuit.

6. An electronic thermal printing terminal having a system clock, an available DC power source, and a thermal printhead selectively activated during a print cycle, the printhead including a temperature sense diode, comprising:

(a) power transistor means connected to the DC power source and to the thermal printhead;

(b) control timing means connected to the power transistor means for permitting the power transistor means to close and open, thereby respectively connecting and disconnecting the thermal printhead from the DC power source;

(c) duty cycle varying means connected to the control timing means for activating the control timing means to vary the time of the power transistor means to be opened and closed within a fixed cycle time, including transmission gate means connected to receive the output of the temperature sense diode as a reference voltage for isolating the reference voltage during the print cycle; and (d) pulse integrating means connected to the printhead for providing a voltage indicative of power applied to the printhead, and connected to the duty cycle varying means to activate the duty cycle varying means when the indicative voltage reaches the reference voltage, and to deactivate the duty cycle varying means when the indicative voltage drops below the reference voltage.

7. The terminal of claim 6 wherein the control timing means comprises a latch circuit having an output electrically connected to the control electrode of the power transistor means, an input connected to receive signals from the system clock, and a reset input for clearing the latch circuit, the reset input being connected to the output of the duty cycle varying means.

8. The terminal of claim 7 wherein the duty cycle varying means comprises a comparator means having one input electrically connected to the reference voltage and another input connected to the pulse integrating means to cause the latch circuit to clear when the amplitude of the indicative voltage reaches the reference voltage amplitude.

9. The terminal of claim 8 wherein the pulse integrating means comprises a resistor-capacitor circuit.

10. The terminal of claims 6, 7, 8 or 9 further comprising store and hold capacitor means, connected to the output of the transmission gate means, for storing the reference voltage for comparison during the print cycle.

11. The terminal of claim 10 wherein the power transistor means comprises a primary power transistor for connecting the DC power source to the printhead and a secondary power transistor for maintaining a predetermined minimum voltage during the print cycle when the power transistor means is opened.

* * * * *